US007707679B2

(12) United States Patent
Young

(10) Patent No.: US 7,707,679 B2
(45) Date of Patent: May 4, 2010

(54) SQUEEGEE DEVICE

(76) Inventor: Ronald Alexander Young, 95 Mushroom Green, Dudley Wood, West Midlands DY2 0EE (GB)

( * ) Notice: Subject to any disclaimer, the term of this patent is extended or adjusted under 35 U.S.C. 154(b) by 53 days.

(21) Appl. No.: 11/704,362

(22) Filed: Feb. 9, 2007

(65) Prior Publication Data

US 2007/0199171 A1 Aug. 30, 2007

(30) Foreign Application Priority Data

Feb. 14, 2006 (GB) ..... 0602879.9

(51) Int. Cl.
*A47L 1/06* (2006.01)
*A47L 13/11* (2006.01)

(52) U.S. Cl. ..... 15/245; 15/118; 15/144.2; 134/6

(58) Field of Classification Search ..... 15/105, 15/121, 144.1, 244.2, 245, 220.1, 106–118, 15/144.2; 134/6
See application file for complete search history.

(56) References Cited

U.S. PATENT DOCUMENTS 117,997 A * 8/1871 Earnest ..... 401/139
629,835 A * 8/1899 Wertsbaugher ..... 15/121
1,487,344 A * 3/1924 Lukens ..... 15/250.28
1,897,726 A * 2/1933 Hillyard ..... 15/121
1,998,634 A * 4/1935 Oberti ..... 15/231
2,771,623 A * 11/1956 Baril ..... 15/144.1
4,409,700 A * 10/1983 Sullivan ..... 15/121
5,528,793 A * 6/1996 Schbot ..... 15/245
5,539,949 A * 7/1996 Stanton ..... 15/121
5,845,361 A * 12/1998 Murakami et al. ..... 15/231
6,625,837 B2 * 9/2003 Jiang ..... 15/105
2003/0028995 A1 * 2/2003 Ikeda ..... 15/401
2004/0177461 A1 * 9/2004 Ajluni ..... 15/121
2006/0112512 A1 * 6/2006 McNeil ..... 15/250.48

FOREIGN PATENT DOCUMENTS

BE 904750 9/1986
WO WO 89/10721 11/1989

* cited by examiner

*Primary Examiner*—Randall Chin
(74) *Attorney, Agent, or Firm*—Young & Thompson

(57) ABSTRACT

A manual squeegee device for the movement of residual liquid on a surface, the squeegee device including a support element, first and second elongate blade holders and a coupling, the blade holders being in spaced apart generally parallel relationship, and each supporting a respective first and second non-absorbent flexible elongate blade each of which provides a wiping edge, the wiping edges lying in or substantially in a common plane, the support element being between the spaced apart blade holders and carrying the coupling, the coupling permitting of engagement with a handle, and permitting the handle in use to pivot universally relative to the support element.

13 Claims, 3 Drawing Sheets

SQUEEGEE DEVICE

BACKGROUND TO THE INVENTION

This invention relates to a squeegee device and, more particularly, to a manually operable squeegee device which is intended to move residual liquid on a floor surface.

DESCRIPTION OF THE PRIOR ART

Handheld squeegees are well known. In particular, small single blade devices are used by window cleaners to remove residual liquid from windows. Larger single blade squeegee devices are known for use on floors and similar large area surfaces, typically following a mopping operation.

The single blade squeegee comprises a support element to which a handle is is mounted. The handle is fixed relative to the support element. A blade holder is provided, typically integrally formed with the support element, and a single flexible elongate, typically rubber, blade is held in the blade holder.

The problem with this kind of squeegee device is that, especially on larger versions, maneuverability may be difficult. If the blade is not kept in content contact and at the right angle to attack to the surface being cleaned, residual liquid may be missed. Moving the squeegee device quickly, with tight turns is particularly difficult, and accessing narrow or tight areas, can be troublesome since the blade tilts or rises, leading again to missed liquid.

According to a first aspect of the present invention, there is provided a manual squeegee device for the movement of residual liquid on a surface such as a floor. The squeegee device may include a support element, first and second elongate blade holders and a coupling. The blade holders may be in spaced apart generally parallel relationship and each may support a respective first and second non-absorbent flexible elongate blade. The blades may be held by the first and second blade holders, respectively, and may project therefrom so that projecting edges of the first and second blades lie in or substantially in a common plane. The device may include a pivotable coupling carried by the support element and an opposite end engaged or engagable with a handle, so that, in use, the handle can pivot relative to the support element.

The present invention thus provides a stable and highly maneuverable squeegee device which is particularly suitable for quickly moving residual liquid over a large area.

The pivotable coupling may be a universal coupling carried by the support element between the first and second blade holders.

The first and second blade holders and/or the wiping edges of the blades may be raked, so that the first and second blades present a raked, preferably single, edge to the floor, so that when the device is at rest, with the handle generally upright, the blades each extend at a less than normal angle to the surface to be wiped.

The first and second blades may be formed of closed cell rubber material such as polychloroprene.

According to a second aspect of the present invention, there provided a method of moving without removing residual liquid on a floor using a squeegee device according to the first aspect of the invention, in a side-to-side manner so as to describe or substantially describe a figure of eight as the surface to be cleaned is traversed, such that the residual liquid is moved to or towards a single location on the surface to be cleaned.

BRIEF DESCRIPTION OF THE DRAWINGS

Embodiments of the invention will now be more particularly described, by way of example only, with reference to the accompanying drawings, in which.

DESCRIPTION OF THE PREFERRED EMBODIMENTS

Figure 1:
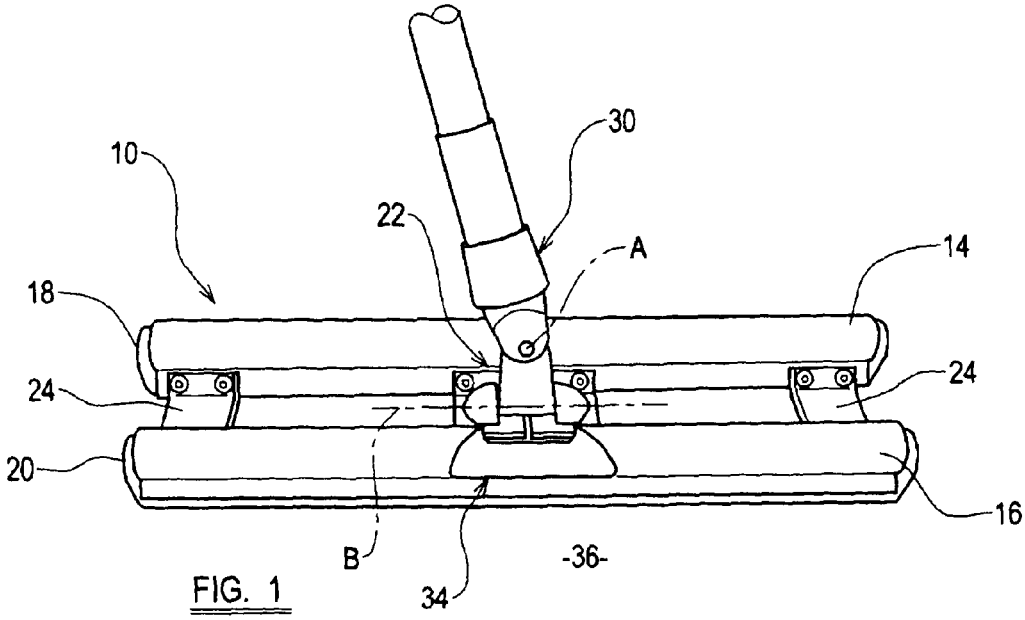
FIG. 1 is a perspective view from above of one embodiment of a squeegee device, in accordance with the first aspect of the invention.
Figure 2:
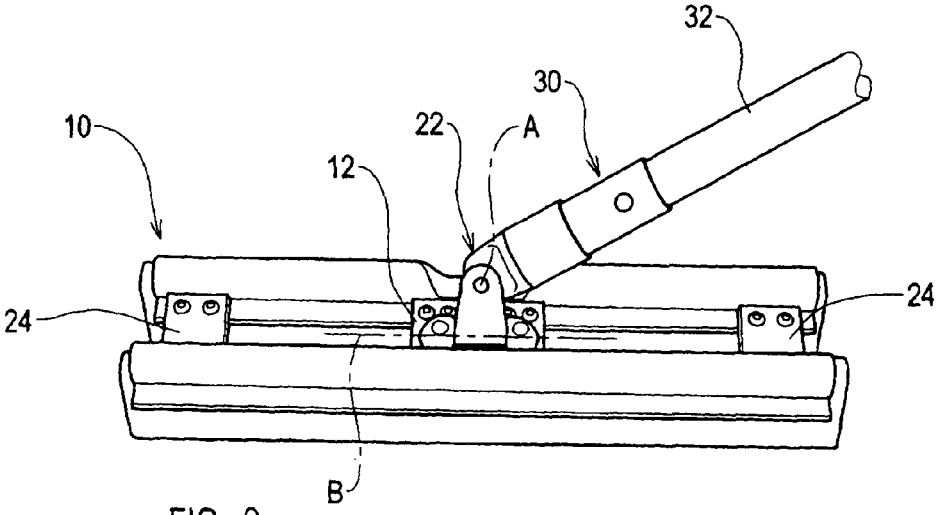
FIG. 2 is a perspective view from the other side of the squeegee device shown in FIG. 1.
Figure 3:
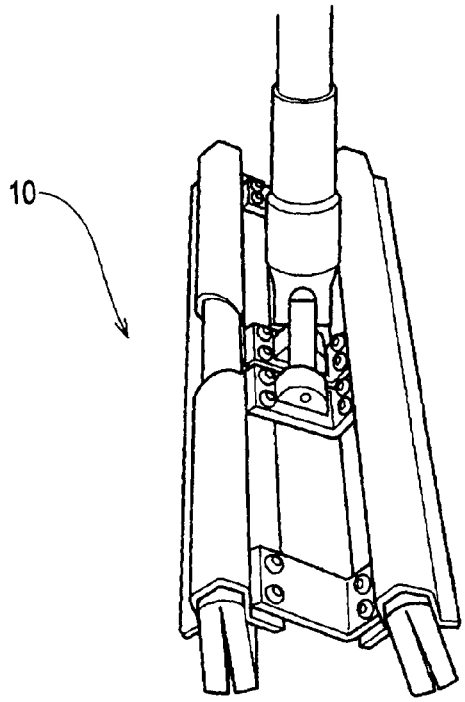
FIG. 3 is a perspective view from one end of the squeegee device.
Figure 4:
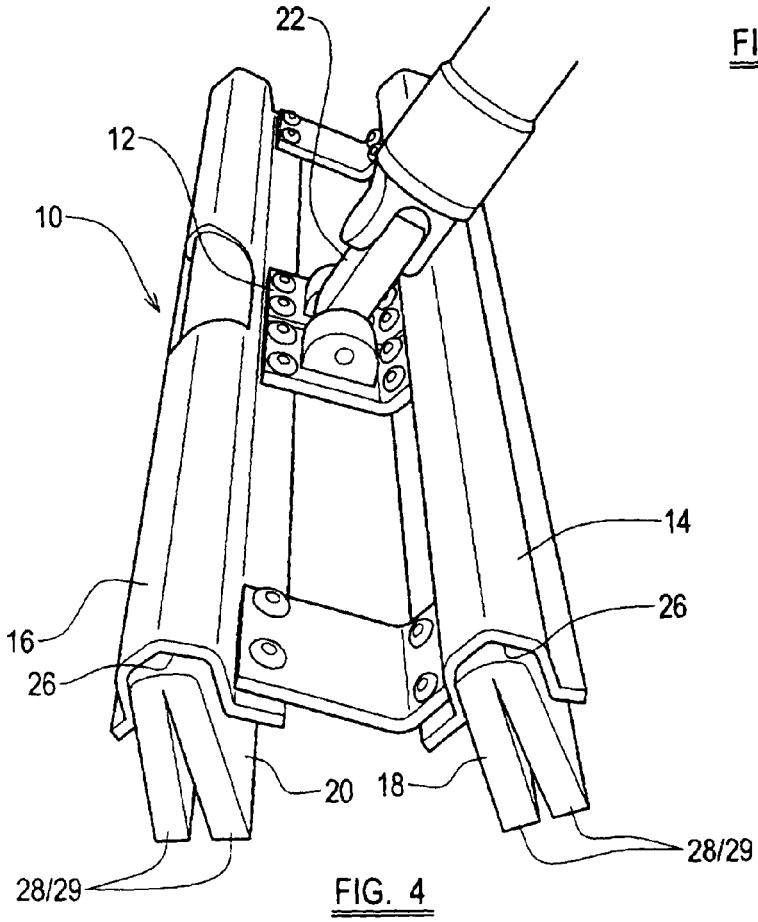
FIG. 4 is an enlarged view of the one end of the squeegee device shown in FIG. 3.

Referring now to FIGS. 1 to 4 of the drawings, there is shown a squeegee device 10 which includes a support element 12, first and second, typically plastics, elongate blade holders 14, 16 attached to the support element 12, first and second blades 18, 20 which are held by the first and second blade holders 14, 16, respectively, and a universal coupling 22.

The first and second blade holders 14, 16 are fixed midway between their ends to opposite sides of the support element 12, so that they extend in spaced parallel relationship. Further blade elements 24 interconnect the first and second blade holders 14, 16 at positions along their longitudinal extents and which are spaced from the support element 12.

Each one of the first and second blade holders 14, 16 includes a rectilinear elongate channel 26 which is dimensioned to receive a respective one of the blades 18, 20. Each blade 18, 20 is elongate and flexible, typically being formed from non-absorbent Neoprene® or another kind of non-absorbent polychloroprene or other material. Other types of non-absorbent, typically rubber material, can be used. The e.g. polychloroprene material is preferably closed-cell.

Each blade 18, 20 is formed by folding a rectangular sheet of the blade material, double, preferably equally or substantially equally along its longitudinal extent, with the longitudinal folded edge being received in the channel 26, and the free or projecting wiping edges 28, 29 being positioned adjacent to each other in spaced relationship with the channel 26.

Each blade 18, 20 may be permanently held in its respective channel 26 by a clamp element (not shown) riveted to the channel 26, e.g. at the fold line of the blade material. Alternatively, the blade 18, 20 can be releasably held in the channel 26, e.g. by a disengageable clamp, so that it can be removed and replaced, if necessary.

Each channel 26 is raked or slanted in a lateral direction of the first and second blade holders 14, 16. The rake is in a direction from the second blade holder 16 to the first blade holder 14. Each blade 18, 20 thus presents raked projecting wiping edges 28, 29 and thus also a common angle of attack, which prevents or limits juddering of the blades 18, 20 as they are moved across a surface to be cleaned.

It will be appreciated that, although in this example, the channels 26 are raked, a deviation can be introduced into the material of the blades, whereby the channels 26 need not be raked, but the blades 18, 20 may provide raked wiping edges 28, 29. Consequently, in this case, the channels 26 of the blade holders 14, 16 do not themselves need to be raked.

The raked edges 28, 29 of each blade 18, 20 provided by the edges of the folded over material, lie in or substantially in a common plane. Typically, mouths of the channels 26 of the first and second blade holders 14, 16 are also positioned in or on a common plane. However, the first and second blade holders 14, 16 can be offset, in which case the lateral dimensions of the first and second blades 18, 20 may need to be different, to allow the raked wiping edges 28, 29 of the first and second blades 18, 20 still to be co-planar.

The universal coupling 22 is a handle attachment element which is connected to, but may be integrally formed, or otherwise carried at one side of the support element 12, and which presents a socket 30 at the opposite side for receiving a, typically long, shaft or handle 32. The universal coupling 22 allows 360° of unrestricted free pivoting of the handle 32, when attached, relative to the support element 12 and blade holders 14, 16 about generally perpendicular axes A, B. The large degree of free movement of the handle 32 results in the first and second blades 18 20 rarely, if ever in use, being lifted or tilted away from the surface being cleaned, due to moments imparted by the handle 32 contacting one or other of the blade holders 14, 16.

Although a universal coupling 22 is suggested, any handle attachment element which allows unrestricted, universal, or substantially unrestricted pivoting movement of the attached handle 32 in all directions, can be utilised, and the phrase "universal coupling" is intended to cover this.

Furthermore, a coupling which permits the handle 32 to pivot in one plane could be utilised, although separation of the first and second blade 18, 20 from a surface being cleaned may be more likely to occur.

The second blade holder 16, which in use, is typically closest to a user, includes a recessed portion 34 in an uppermost surface, to accommodate the socket 30 of the universal or other coupling 22 and/or handle 32 when in a lowered condition, for example, when the handle 32 is lowered to adjacent a surface being cleaned as the squeegee device 10 is moved beneath an item with low floor clearance, such as shelving. Although not seen as being necessary, due to the rake of the channels 26 or the edges 28, 29 of the blades 18, 20 resulting in the squeegee device 10 typically not being used when reversed, the first blade holder 14 could also include a recessed portion (not shown) in its uppermost surface, to accommodate the socket 30 of the universal joint and/or attached handle 32.

With a handle 32 attached to the universal coupling 33, the squeegee device 10 is, in use, moved by a user standing closer to the second blade holder 16 than the first blade holder 14, in a side-to-side manner over a surface to be cleaned. The surface to be cleaned is typically a floor surface 36, for example at a restaurant, and will have already been mopped, thus leaving a layer of residual liquid on the surface.

As the squeegee device 10 is moved forwardly and rearwardly and, side-to-side, a figure-of-eight movement may be imparted to the squeegee device 10, so that the movement follows a figure-of-eight path as the floor is traversed. This is possible due to the provision of the universal coupling 22 and the spaced apart blades 18, 20 both of which remain in constant simultaneous contact with the floor surface 36, thus stabilising the squeegee device 10. Repetitious figure-of-eight movements are particularly beneficial in collecting and moving residual surface liquid to or towards a single location on the floor.

Once residual surface liquid has been moved to a more localised position, a mop or other absorbent device can be used to transfer the liquid to a container or sink, or the liquid may be received by a floor drain.

The universal coupling 22, gives the squeegee device 10 great maneuverability. The stability of the squeegee device 10 is also extremely high, due to the twin catamaran-like spaced apart blade holders 14, 16 and blades 18, 20. The universal coupling 22 allows the handle 32 to be positioned parallel or substantially parallel with the floor surface 36 being cleaned, when necessary, whilst the wiping edges of the first and second blades 18, 20 still remain in good positive contact with the floor surface 36. Consequently, hard to reach areas, such as under shelves, sinks, worktops and tables can be confidently reached.

Although the first and second blade holders 14, 16 are in the FIGS. 1 to 4 embodiment, of matching or substantially matching lengths, typically being in the range of 300 to 800 millimetres (mm), the blade holders 14, 16, and thus the blades 18, 20, can be of different lengths. In this case, the second blade holder 16 which is typically closer to the user can be shorter than the first 14 blade holder. For example, the first blade 18 can be in the range of 300 to 800 mm long, and the second blade 20 can be 60 g to 300 mm long.

Figure 5:
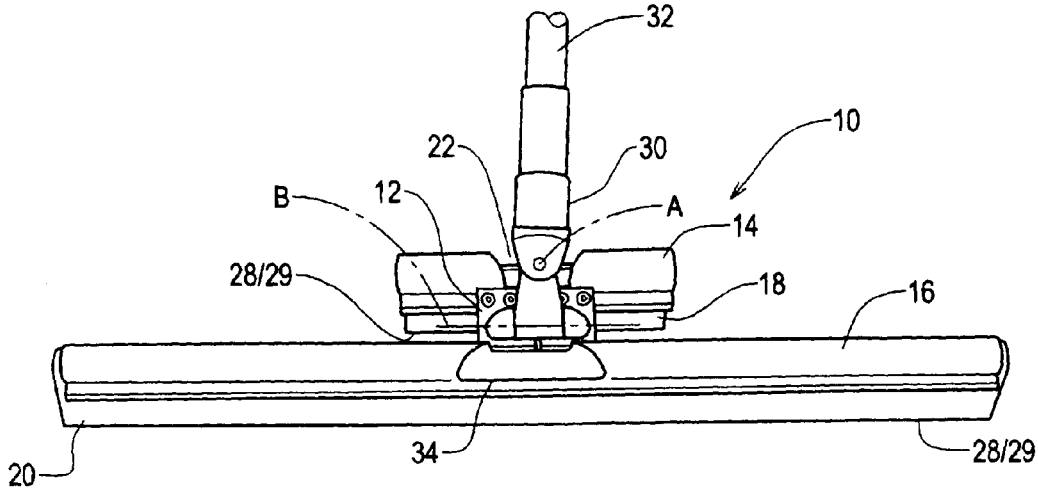
FIG. 5 is a view similar to FIG. 1, but of an alternative embodiment.
Figure 6:
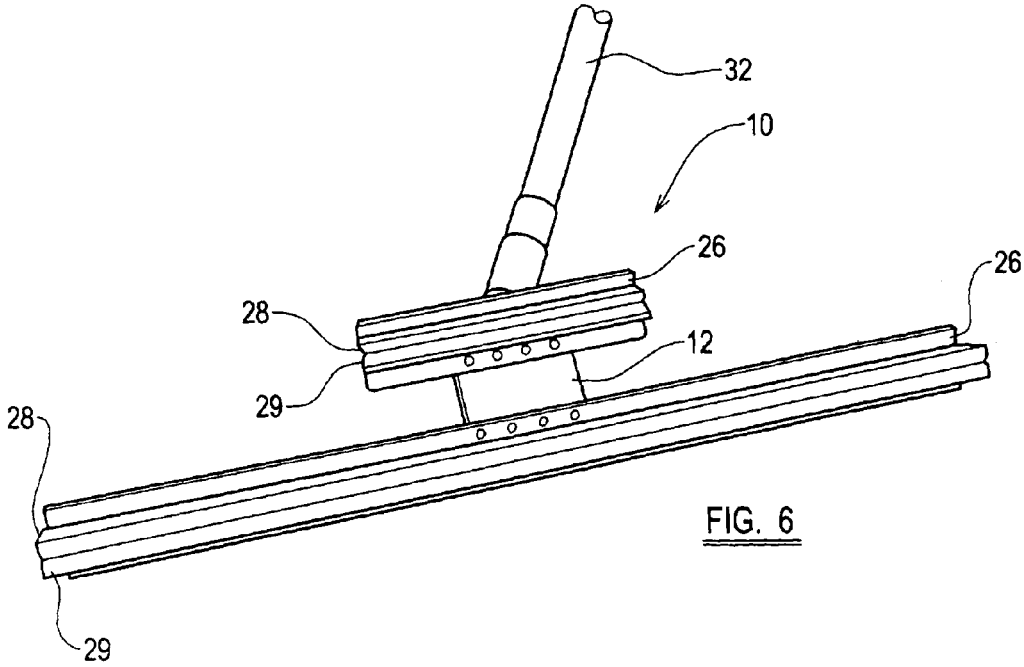
FIG. 6 is an underside perspective view of the device of FIG. 5.

An example of such an embodiment is illustrated in FIGS. 5 and 6 in which like parts to those in FIGS. 1 to 4 are labelled with the same references.

The support element 12 and blade holders 14, 16 can in another arrangement, be integrally formed with each other rather than secured together as in the examples illustrated.

In another embodiment, one or both blades 18, 19 need not be a folded layer of material but may be a single sheet of blade material. However, folding does reinforce the blade 18, 20 enabling supple but resilient blade wiping edges 28, 29 to be presented to the floor surface. In another example, the blades 18, 20 may be provided by a non-sheet material, held in or by the blade holders permanently or releasably, by any desired means.

Although the squeegee device 10 described above is primarily intended to aid in moving residual liquid over, but not removing residual liquid from, a freshly mopped floor surface, a squeegee device 10 in accordance with the invention can be used to move residual liquid on other surfaces, such as work tops, table tops, and windows.

Polychloroprene material for the blades 18, 20, is a cheap material which, in combination with the simple structure of the remainder of the squeegee device 10, allows disposal of the entire device 10 once the blades 18, 20 are worn, rather than replacement of only the blades 18, 20. However, as mentioned above, it is feasible to provide a device with replaceable blades 18, 20.

The squeegee device 10 is an entirely manually operated device 10, with no electric motors and no gear mechanisms. This results in the manufacturing costs being low.

The embodiments described above are given by way of examples only, and various other modifications will be apparent to a person skilled in the art without departing from the scope of the invention, as defined by the appended claims. For example, one or both blade holders could have an arcuate longitudinal extent, instead of rectilinear, so that the respective blade 18, 20 could be arcuate.

The invention claimed is:

1. A manual squeegee device for the movement of residual liquid on a surface, the squeegee device comprising:

an angled support element comprising a first edge and a second edge wherein the first edge is shorter than the second edge and an obtuse angle is subtended between the first edge and the second edge;

first and second elongate blade holders attached to and spaced apart by the angled support element; and a coupling in connection with the blade holders, wherein the blade holders are in spaced apart generally parallel relationship, and each supporting a respective first and second non-absorbent flexible elongate blade each of which provides a wiping edge, the wiping edges lying in or substantially in a common plane, wherein the support element is between the spaced apart blade holders, a first of the blade holders being attached to the first edge at a first end of the support element, and a second of the blade holders being attached to the second edge at a second end of the support element, and wherein the coupling is configured to engage with a handle and permits the handle in use to pivot universally relative to the support element.

2. A squeegee device as claimed in claim 1, wherein the coupling is a universal coupling carried by the support element between the first and second blade holders.

3. A squeegee device as claimed in claim 1, wherein the first and second blade holders are raked, so that when the device is at rest the first and second blades each extend to a less than normal angle to the surface to be wiped.

4. A squeegee device as claimed in claim 1, wherein the first and second blades are configured so that the wiping edges each extend at a less than normal angle to the floor when the device is at rest.

5. A squeegee device as claimed in claim 1, where in the first and second blades are formed of closed cell rubber material.

6. A squeegee device as claimed in claim 5, wherein the closed cell rubber material is polychloroprene.

7. A squeegee device as claimed in claim 1, wherein the first and second blades are provided by sheet material folded to form a double layer.

8. A squeegee device as claimed in claim 1, wherein the first and second blade holders are of the same or substantially of the same length.

9. A squeegee device as claimed in claim 1, wherein the first and second blade holders are of different lengths.

10. A squeegee device as claimed in claim 1, wherein the coupling permits the handle in use to pivot about two axes of rotation, the axes being substantially perpendicular to each other.

11. A manual squeegee device for the movement of residual liquid on a surface, the squeegee device comprising:

a handle;

a first non-absorbent flexible elongate blade with a first wiping edge;

a first blade holder supporting the first blade;

a second non-absorbent flexible elongate blade with a second wiping edge, the first and second wiping edges being in a common plane;

a second elongate blade holder supporting the second blade, the second blade holder being in a spaced apart, generally parallel relationship with the first blade holder;

a support element located between the spaced apart blade holders, the support element comprised of a first edge and a second edge, wherein the first edge is shorter than the second edge, and an obtuse angle is subtended between the first and second edges; and a universal coupling mounted to the support element, the support element mounted to the first and second blade holders, the coupling engaged with the handle, wherein the first blade holder is attached at a first end of the support element on the first edge, and the second blade holder is attached at an opposite second end of the support element on the second edge, and wherein the handle in use is configured to pivot universally relative to the support element.

12. A method of moving, without removing, residual liquid on a surface to be cleaned, the method including the step of: providing the manual squeegee device of claim 1; moving the squeegee device on the surface in a side-to-side manner so as to at least substantially describe a figure-of-eight while traversing the surface, such that the residual liquid is moved towards a single location on the surface.

13. The method as claimed in claim 12, wherein the handle, engaged to the coupling, pivots about two axes of rotation, the axes being substantially perpendicular to each other.

* * * * *